US006811836B1

(12) United States Patent
Johnson et al.

(10) Patent No.: US 6,811,836 B1
(45) **Date of Patent: *Nov. 2, 2004**

(54) DISPLAY TREE WITH BUBBLE TRUNK

(76) Inventors: Jayson A. Johnson, 4083 Parkview Dr., Salt Lake City, UT (US) 84124; Ronald F. Johnson, 4083 Parkview Dr., Salt Lake City, UT (US) 84124; Susan S. Johnson, 4083 Parkview Dr., Salt Lake City, UT (US) 84124

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 688 days.

(21) Appl. No.: 09/196,938

(22) Filed: Nov. 20, 1998

(51) Int. Cl.[7] ..... A41G 1/00

(52) U.S. Cl. ..... 428/20; 428/18; 428/27; 362/101; 362/123; 211/205; 40/406; 40/407

(58) Field of Search ..... 428/18, 20, 17, 428/7, 15, 34.1, 19, 10, 27; 119/253, 254; 362/96, 123, 101; 211/196, 205; 40/406, 407

(56) References Cited

U.S. PATENT DOCUMENTS

| | | | | | |
|---|---|---|---|---|---|
| 2,550,023 | A | * | 4/1951 | Reilly | |
| 3,706,145 | A | | 12/1972 | Oliveri | 40/106 |
| 3,995,151 | A | | 11/1976 | Nordeen et al. | 240/10 |
| 4,020,337 | A | | 4/1977 | Chatten | 240/10 |
| 4,331,720 | A | * | 5/1982 | Vin Dick et al. | |
| 5,085,900 | A | * | 2/1992 | Hamlett | |
| 5,104,608 | A | | 4/1992 | Pickering | 362/32 |
| 5,349,771 | A | * | 9/1994 | Burnett | |
| 5,363,577 | A | | 11/1994 | Fuller et al. | 40/406 |
| 5,420,765 | A | | 5/1995 | Nordeen et al. | 362/96 |
| D390,157 | S | * | 2/1998 | Burnett | |
| 5,819,452 | A | | 10/1998 | Hakkert | 40/406 |
| 5,939,154 | A | * | 8/1999 | Gonzalez | |
| 6,099,920 | A | * | 8/2000 | Kao | |

* cited by examiner

*Primary Examiner*—Deborah Jones
*Assistant Examiner*—Wendy Boss
(74) *Attorney, Agent, or Firm*—Mallinckrodt & Mallinckrodt; Robert R. Mallinckrodt

(57) ABSTRACT

A display representing a tree, such as a Christmas tree, has a trunk made of a hollow tube and held by a base in substantially vertical position. A liquid, such as water, is placed in the tube and an air supply in or near the bottom of the tube generates bubbles that rise through the tube. The tube and bubbles therein are preferably illuminated to add to the effectiveness of the display. Branches are secured to the trunk tube and extend outwardly therefrom to provide tree foliage and give the display the appearance of a tree or support foliage, such as in the form of a garland, which provides the tree foliage and gives the display the appearance of a tree.

18 Claims, 2 Drawing Sheets

DISPLAY TREE WITH BUBBLE TRUNK

BACKGROUND OF THE INVENTION

1. Field

Figure 1:
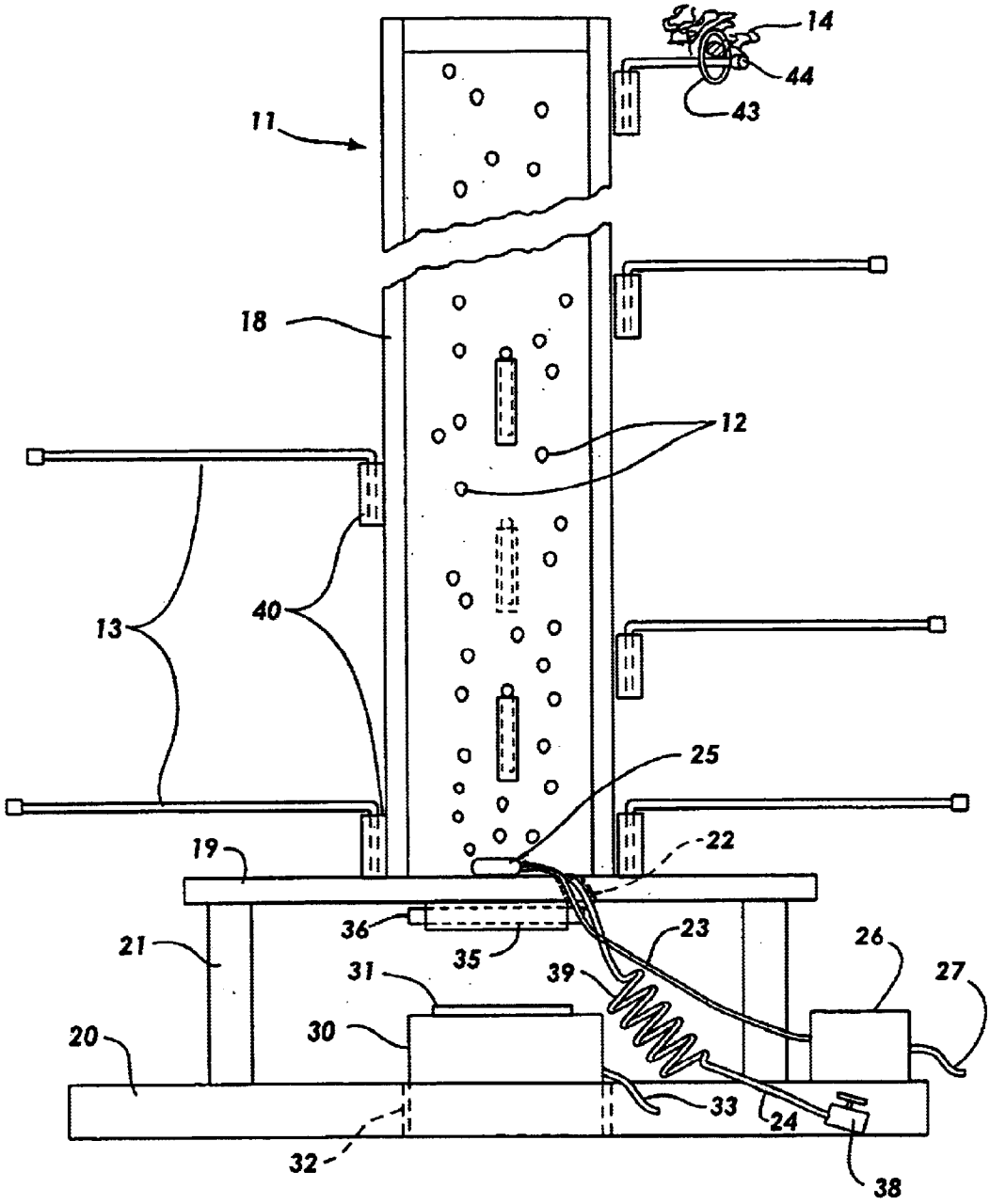

The invention is in the field of displays giving the appearance of or representing trees and particularly giving the appearance of a Christmas tree. Thus, the field includes the field of artificial Christmas trees.

2. State of the Art

There are many types of artificial Christmas trees currently available, some with built-in lights or light displays. There are also Christmas tree light sets and ornaments that generate bubbles in a tube full of fluid. Further, there are large displays that include bubble tubes and bubble walls where bubbles rise through fluid in such tubes and walls. However, applicants are not aware of any Christmas trees or other display trees which themselves incorporate a bubble display as part of the tree itself.

SUMMARY OF THE INVENTION

According to the invention, a tree display, such as an artificial Christmas tree although the tree display could be used for other occasions such as a Valentine tree, Easter tree, etc., has a trunk formed from a hollow tube configured to hold a liquid, such as water, therein. A base holds the tube in a substantially vertical position on a surface, such as a floor, table, or cabinet. An air supply means is located in the tube, preferably at or near the bottom of the tube, for supplying air to the tube to form bubbles in the liquid when in the tube. The air supply means can conveniently be an aquarium air supply which provides a stream of bubbles to the liquid. The air outlet of the air supply is located in the bottom of the tube with an air supply hose extending through the bottom of the tube to an air pump located outside the tube. It is also convenient to provide a drain hose extending through the bottom of the tube with the air supply hose. A drain valve in the drain hose selectively opens and closes the drain hose outside the tube so the tube can be conveniently drained when desired.

Preferably an illumination means, such as a light fixture, is positioned in the base to shine light onto and into the bottom of the tube. The light can be colored in various ways to create a desired display effect.

A plurality of branch means are mounted on the hollow tube and extend outwardly from the tube to represent tree branches and/or as a support for foliage means which is supported by the branch means to give the display the appearance of a tree. The branch means may be lengths of substantially rigid rods each with a mounting end bent substantially perpendicular to a substantially rigid branch portion. The mounting ends are removably inserted into mounting sleeves secured around the hollow tube with similar orientation to the hollow tube. The rods extend outwardly from the hollow tube (tree trunk) in preferably a helical pattern with the upper rods being shorter than the lower rods to give a pine tree shape. With the substantially rigid rods, a Christmas tree can be formed by securing an artificial pine or spruce foliage garland to the ends of the rods so the garland begins at the top of the tree and spirals in helical fashion from the top of the tree around the hollow tube to the bottom of the tree with the tree getting wider top to bottom. The garland may be formed with ornaments and lights built into the garland.

With the above-described specific construction, the tree can be stored by removing the branches from the hollow tube trunk, starting at the bottom, and placing them in a helical mound or stack in a storage box or other container.

THE DRAWINGS

Figure 3:
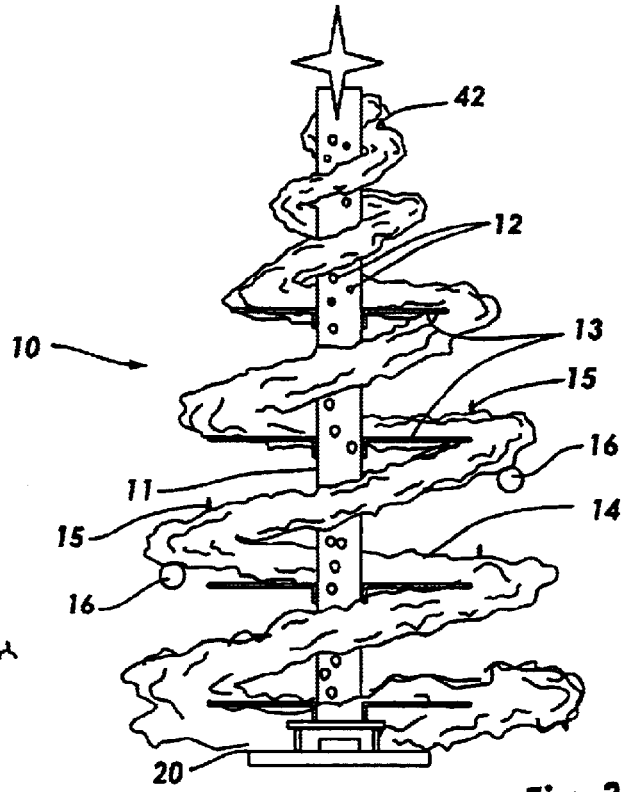
Figure 2:
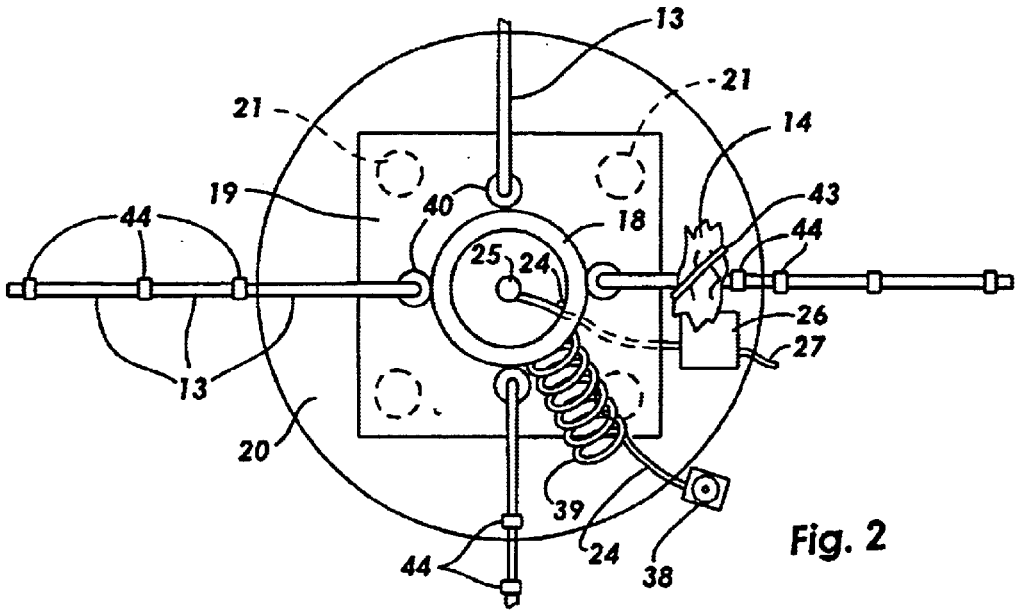

The best mode presently contemplated for carrying out the invention is illustrated in the accompanying drawings, in which:

FIG. 1 is a side elevation, with a portion broken away, of the base and trunk of a tree display of the invention;

FIG. 2, a top plan view of the tree display of FIG. 1 drawn to a smaller scale;

FIG. 3, a side elevation of a tree display of the invention; and

Figure 4:
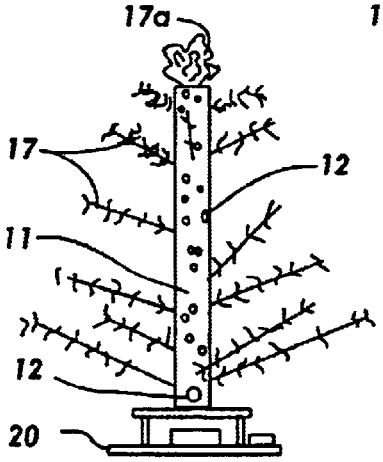

FIG. 4, a side elevation of a different embodiment of a tree display of the invention.

DETAILED DESCRIPTION OF THE ILLUSTRATED EMBODIMENT

The invention in one embodiment is a display 10, FIG. 3, representing a tree, such as a Christmas tree as shown, having a bubble trunk 11, i.e., a trunk which is substantially transparent and has bubbles 12 moving upwardly therein with the bubbles preferably illuminated. The tree can have various shapes and themes and be formed by branch means and foliage means in various ways. A Christmas tree as illustrated in FIG. 3 has branch means 13 extending from the trunk and supporting foliage means in the form of a garland 14. With a Christmas tree, the garland may be formed with Christmas tree lights 15 and ornaments 16 included as part of the garland. Of course, lights and ornaments may be added separately and the tree could have other than a Christmas theme, such as an Easter theme, with appropriate foliage and decorations for the theme involved.

A tree with branch means 17 that include the foliage is shown in FIG. 4. A top 17*a* is provided to finish the tree appearance, the tree trunk 11 with bubbles 12 and other parts of the tree are similar to those of FIG. 3.

In a presently preferred embodiment of the invention, the tree trunk 11 includes a hollow tube 18 secured to a base which includes upper base plate 19 and lower base plate 20, secured together by spacers 21. Upper base plate 19 seals the bottom of hollow tube 18 to make it fluid tight, and a hole 22 through upper base plate 19 allows an air supply hose 23 and a drain hose 24 to pass therethrough. Hole 22 around hoses 23 and 24 is sealed with a sealing material such as a silicone rubber. An air stone or other air spreading and bubble forming means 25, such as commonly used in aquariums, is located in hollow tube 18, preferably at the bottom of the tube, and is attached to air supply hose 23. The end of air supply hose 23 outside of tube 18 is coupled to a source of air 26 such as an electrically powered air pump, again as commonly used for aquariums. Electrical power is supplied to pump 26 by wire 27.

Air pump 26 pumps air through air supply hose 23 to air stone 25. When hollow tube 18 is filled with a liquid, such as water, the air leaving air stone 25 causes bubbles 12 to form and to rise in the liquid in tube 18. The top of tube 18 is open to the atmosphere.

It is preferred to illuminate hollow tube 18 and the bubbles rising therein to increase the pleasing visual effect of the bubbles rising in the tube. For that purpose, an illumination means such as a light fixture 30 with light bulb 31 is positioned in the base such as on or in lower base plate 20 so that light from bulb 31 is directed into and through hollow tube 18 to illuminate it. As shown, light fixture 30 may be positioned in an opening 32 in lower base plate 20, or, if no hole is provided in base plate 20, the fixture can merely rest on plate 20. Power to fixture 30 is provided through electrical cord 33.

In many cases it may be desired to color the light directed into hollow tube 18. Bulb 31 may be a colored bulb, or to make color changes easy, slide bracket 35 may be mounted on upper plate 19 immediately below tube 18 to removably receive a piece of colored or dyed plastic 36. Such piece 36 of colored plastic can be removed and replaced to provide different colors at different times. If desired, various other means of coloring or changing colors can be used. For example, where continuously changing colors are desired, a motorized color wheel can be located in the base so that changing color media is passed between bulb 31 and the bottom of tube 18 so that the light illuminating tube 18 is colored by the media of the color wheel.

It is convenient to provide a drain hose 24 with valve 38 at the end thereof outside of tube 18. Inside the tube, drain hose 24 ends in an open end substantially at the bottom of the tube. The tube can be of any desired length and coiled as at 39 so valve 38 can be moved to a liquid receptacle and opened when it is desired to drain liquid from tube 18. If drain hose 24 is not provided, it is merely necessary to lift and tip tube 18 with its base to pour liquid from the tube.

To complete the tree display, a plurality of branch means are provided extending outwardly from and around tube (trunk) 18. These branch means may take various forms such as artificial pine boughs or branches 17 as used in the usual artificial Christmas trees and as shown in FIG. 4, or may take the form of supports, such as rods 13, which extend from tube 18 to support foliage means such as the foliage garland 14. Rods 13 should be substantially rigid to the extent that they can adequately support garland 14, but may have some give or elasticity when hit or walked into. Rods of about three-sixteenths inch cold rolled steel have been found satisfactory. Such rods are formed with a substantially rigid portion extending from the tube 18 and a usually substantially perpendicular, relatively short mounting portion. Mounting tubes or sleeves 40 are secured to hollow tube 18 at spaced intervals around tube 18 to removably receive and hold the mounting portions of rods 13, as shown. In this way, rods 13 can rotate to some extent in mounting sleeves 40 if hit or walked into and can be removed for storage of the display tree. While various arrangements of branches 13 may be used, it is presently preferred that branches 13 be arranged in rings around tube 18 or, as shown, be arranged in helical fashion around tube 18. It is also preferred in order to provide the shape of a Christmas tree that the branches 13 get progressively larger from the top of the tube 18 (the top of the tree) to the bottom as indicated partially in FIGS. 1 and 2.

The foliage garland may be placed on top of tube 18, trunk 11 in FIG. 3, as at 42, FIG. 3, and may then be secured to branches 13 as it spirals from the top of the tree to the bottom thereof in ever widening manner. The garland may be secured to the ends of rods 13 by ties 43, FIGS. 1 and 2. When steel rods are used, it may be desirable to provide plastic caps 44, FIGS. 1 and 2, over the ends of rods 13.

The tube 18 (trunk 11) should be substantially transparent so that the bubbles in the tube can be seen through the walls of the tube. It has been found that tubes of transparent acrylic are satisfactory. Tubes with diameters of three to six inches work well with the larger diameter tubes being used with taller trees. For example, a six inch diameter tube can be used for a seven foot tall trunk tube 18, a five inch diameter tube for a five foot tall trunk tube, and a three inch diameter tube works well for a three foot tall trunk tube. Of course these dimensions may vary as may the materials. It has also been found satisfactory to make the base of acrylic plates with spacers 21 being acrylic tubes. Mounting sleeves 40 may also be acrylic tubes, with tubes of about one-half inch outside diameter and about one-quarter inside diameter being satisfactory for use with the three-sixteenths inch branch rods 13. The sleeves 40 can be attached to the trunk tube 18 with glue such as a Weldon acrylic quick-drying glue.

The sleeves 40 can be placed at ninety degree intervals around trunk tube 18, as shown in FIGS. 1 and 2, or at various other intervals depending upon the foliage used, support needed, and appearance to be achieved.

It has been found that when using a foliage garland and removable branch rods, that the rods and attached garland can be easily removed from the trunk tube for storage of the display. Starting at the bottom of the tree, the branch rods and attached garland are removed and stacked in helical manner in a storage container until the top of the tree is reached and garland removed and placed on top of the stack. When reassembling the tree, the garland from the top of the stack is placed on top of the trunk tube and branches and garland added from top to bottom.

Various ways of mounting or securing the branch means to the trunk tube can be used other than the sleeves as described. For example, foliage branches 17 in FIG. 4 may be inserted into receiving sockets glued at angles to the trunk tube, or if a thick wall trunk tube is used, to receiving holes found in the trunk tube.

With the trunk of the tree filled with water as described, and aerated by the bubbles as described, it has been found that the trunk tube can function as an aquarium and for further interest in connection with the display, fish can be added to and live in the trunk tube.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A display representing a tree and having a bubble trunk, comprising:

a hollow tube representing the trunk of the tree, said hollow tube configured to hold a liquid therein;

a base for holding the hollow tube in a substantially vertical position on a surface so that the hollow tube has a height;

an air supply means located in the hollow tube for supplying air to the hollow tube;

a plurality of rods mounted on the hollow tube and extending outwardly therefrom spaced along substantially the entire height of the tube to represent tree branches; and a garland representing foliage secured to a selected plurality of rods to extend from rod to rod of the selected plurality of rods and between such rods in a manner to give the appearance of a tree having foliage.

2. A display representing a tree according to claim 1 additionally including rods mounting means on the hollow tube.

3. A display representing a tree according to claim 2, wherein the rods mounting means are mounting sleeves secured about the outside of the hollow tube in an orientation substantially aligned with the hollow tube.

4. A display representing a tree according to claim 3, wherein each rods includes a substantially rigid portion extending from a mounting portion that is received within a mounting sleeve.

5. A display representing a tree according to claim 4, wherein each rods includes a substantially rigid wire configured to form both the substantially rigid portion and the mounting portion.

6. A display representing a tree according to claim 5, wherein the substantially rigid portions and the mounting portions are substantially perpendicular to one another.

7. A display representing a tree according to claim 6, wherein the rods are arranged in helical fashion around the hollow tube.

8. A display representing a tree according to claim 7, wherein the rods are removable mounted in the mounting sleeves.

9. A display representing a tree according to claim 8, wherein the rods and the garland secured thereto can be removed from the hollow tube and stored together in compressed helical configuration.

10. A display representing a tree according to claim 1, wherein the rods are arranged in helical fashion around the hollow tube.

11. A display representing a tree according to claim 1, additionally including illumination means mounted in cooperation with the base to illuminate the hollow tube.

12. A display representing a tree according to claim 11, additionally including coloring means mounted in cooperation with the illumination means to color light illuminating the hollow tube.

13. A display representing a tree according to claim 1, wherein the rods are removably mounted on the hollow tube.

14. A display representing a tree according to claim 5, wherein the hollow tube is formed of a plastic material and wherein each mounting sleeve is a plastic tube glued to the outside of the hollow tube.

15. A display representing a tree according to claim 3, wherein the hollow tube is formed of a plastic material and wherein each mounting sleeve is a plastic tube glued to the outside of the hollow tube.

16. A display representing a tree according to claim 1, wherein each rod of the plurality of rods has an end portion away from the hollow tube, and the garland is secured to the end portion of the plurality of rods.

17. A display representing a tree according to claim 3, wherein the rod is rotatably mounted in a mounting sleeve.

18. A display representing a tree according to claim 1, wherein the rods are moveably mounted to the hollow tube to provide some movement of the rods in relation to the tube.

* * * * *